US006163887A

United States Patent [19]

Rogers et al.

[11] Patent Number: 6,163,887

[45] Date of Patent: Dec. 26, 2000

[54] SIMULATED SHOULDER FOR COSTUMING

[75] Inventors: Priscilla Emslie Rogers, Moraga, Calif.; Raymond K.C. Wong, Hong Kong, China

[73] Assignee: The Paper Magic Goup, Inc., Scranton, Pa.

[21] Appl. No.: 09/280,509

[22] Filed: Mar. 30, 1999

Related U.S. Application Data

[60] Provisional application No. 60/104,182, Oct. 14, 1998.

[51] Int. Cl.[7] ..... A42B 1/18

[52] U.S. Cl. ..... 2/173; 2/206; 2/DIG. 3

[58] Field of Search ..... 2/206, 209.13, 2/DIG. 3, 410, 413, 173; 446/27

[56] References Cited

U.S. PATENT DOCUMENTS

| | | | |
|---|---|---|---|
| D. 50,313 | 2/1917 | McConnell . | |
| D. 58,447 | 7/1921 | McKinley . | |
| D. 78,462 | 5/1929 | Gordon et al. . | |
| D. 171,492 | 2/1954 | Erickson et al. | D3/13 |
| D. 210,816 | 4/1968 | Aach | D2/250 |
| 211,675 | 1/1879 | Weidmann . | |
| D. 247,055 | 1/1978 | Behling et al. | D34/5 R |
| D. 277,207 | 1/1985 | Rodis-Jamero | D21/148 |
| D. 278,164 | 3/1985 | Koper | D21/190 |
| D. 278,258 | 4/1985 | Koper | D21/190 |
| D. 278,259 | 4/1985 | Koper | D21/190 |
| D. 278,261 | 4/1985 | Koper | D21/190 |
| D. 282,861 | 3/1986 | Koper | D21/190 |
| 302,048 | 7/1884 | Stockley . | |
| D. 329,321 | 9/1992 | Ringwood | D2/250 |
| D. 332,420 | 1/1993 | Mankey | D11/121 |
| D. 332,581 | 1/1993 | Mankey | D11/121 |
| D. 332,761 | 1/1993 | Mankey | D11/121 |
| D. 333,281 | 2/1993 | Mankey | D11/121 |
| D. 343,374 | 1/1994 | Hazard, III | D11/160 |
| D. 350,082 | 8/1994 | Tietz | D11/157 |
| D. 388,358 | 12/1997 | Shaw | D11/125 |
| D. 391,190 | 2/1998 | Cohen | D11/121 |
| D. 391,191 | 2/1998 | Cohen | D11/121 |
| D. 419,910 | 2/2000 | Shaw | D11/128 |
| 434,435 | 8/1890 | Eaves . | |
| 437,995 | 10/1890 | Jensen . | |
| 518,347 | 4/1894 | Fuller . | |
| 626,799 | 6/1899 | Walton . | |
| 727,173 | 5/1903 | Merrell . | |

(List continued on next page.)

FOREIGN PATENT DOCUMENTS

| | | |
|---|---|---|
| 123-413 | 10/1984 | European Pat. Off. . |
| 552231 | 4/1923 | France . |
| 989021 | 9/1951 | France . |
| 1096832 | 6/1955 | France . |
| 2 043 487 | 3/1972 | Germany . |
| 5-329179 | 12/1993 | Japan . |
| 204512 | 8/1939 | Switzerland . |
| 12715 | 9/1915 | United Kingdom . |
| 731635 | 6/1955 | United Kingdom . |

OTHER PUBLICATIONS

"Mask Marvals"—The Washington Star Pictorial Magazine Oct. 30, 1955.

"The Paper Bag Mask"—Popular Mechanics Oct. 1956.

*Primary Examiner*—Bibhu Mohanty

*Attorney, Agent, or Firm*—Seidel, Gonda, Lavorgna & Monaco, PC

[57] ABSTRACT

A simulated shoulder is provided for purposes of creating a costume. The shoulder includes a platform having an upper and a lower surface, horizontally disposed support columns defining the periphery of the shoulder platform, and a head supporting structure attached to the upper surface for support of an inflatable bladder. The inflatable bladder is attached to the head supporting structure and simulates a head or supports a costume mask. An elongated support column extends downwardly from the platform. The support column is attached at one end to the platform and spaced apart a sufficient lateral distance so as to accommodate a wearer's head. There is also provided an adjustable flexible strap attached to the support columns to hold the structure to a wearer and for supporting the shoulder platform.

10 Claims, 4 Drawing Sheets

U.S. PATENT DOCUMENTS

| | | | |
|---|---|---|---|
| 885,802 | 4/1908 | Sterrick . | |
| 891,122 | 6/1908 | Wilcox . | |
| 1,097,530 | 5/1914 | Cabelinsky . | |
| 1,391,617 | 9/1921 | Dessart . | |
| 1,560,997 | 11/1925 | Kelly . | |
| 1,655,440 | 1/1928 | Soble . | |
| 2,028,206 | 1/1936 | Hall | 2/206 |
| 2,342,982 | 2/1944 | Stern et al. | 2/9 |
| 2,443,848 | 4/1948 | Boeringer | 2/196 |
| 3,359,570 | 12/1967 | Rodgers | 2/206 |
| 3,561,010 | 2/1971 | Little | 2/173 |
| 4,121,304 | 10/1978 | Cooper | 2/206 |
| 4,170,242 | 10/1979 | Caso | 135/5 C |
| 4,203,457 | 5/1980 | Freidman et al. | 135/5 C |
| 4,218,780 | 8/1980 | Growe et al. | 2/199 |
| 4,285,068 | 8/1981 | Ross | 2/202 |
| 4,451,933 | 6/1984 | Seng et al. | 2/202 |
| 4,485,921 | 12/1984 | Geller | 206/471 |
| 4,653,642 | 3/1987 | Hakun et al. | 206/486 |
| 4,683,588 | 7/1987 | Goldberg | 381/61 |
| 4,690,653 | 9/1987 | Goldberg | 446/27 |
| 4,722,098 | 2/1988 | Stapleton | 2/69 |
| 4,783,350 | 11/1988 | DeMatteo et al. | 428/16 |
| 4,823,407 | 4/1989 | Phillips, Jr. et al. | D24/4 |
| 4,920,580 | 5/1990 | Liff | 2/206 |
| 4,941,211 | 7/1990 | Blustein | 2/202 |
| 4,941,212 | 7/1990 | Liff | 2/206 |
| 5,025,507 | 6/1991 | Kirby | 2/206 |
| 5,046,986 | 9/1991 | Wood et al. | 446/321 |
| 5,091,996 | 3/1992 | Kirby | 2/206 |
| 5,142,704 | 9/1992 | Viemeister et al. | 2/202 |
| 5,146,622 | 9/1992 | Blutstein | 2/4 |
| 5,226,189 | 7/1993 | Blutstein | 2/4 |
| 5,249,307 | 10/1993 | Lemoine | 2/84 |
| 5,287,560 | 2/1994 | Garcia | 2/202 |
| 5,537,687 | 7/1996 | Garza | 2/9 |
| 5,546,604 | 8/1996 | Geller | 2/202 |
| 5,617,584 | 4/1997 | Brennan | 2/206 |
| 5,713,077 | 2/1998 | Humbrecht | 2/173 |
| 5,715,541 | 2/1998 | Landau | 2/425 |
| 5,809,572 | 9/1998 | Sisolak | 2/173 |
| 5,845,340 | 12/1998 | Frislie | 2/202 |
| 5,873,132 | 2/1999 | Grilliot et al. | 2/84 |
| 5,937,445 | 8/1999 | Ravo et al. | 2/173 |
| 5,970,522 | 10/1999 | Apichom | 2/206 |
| 6,000,065 | 12/1999 | Deagan | 2/410 |

SIMULATED SHOULDER FOR COSTUMING

This appln claims the benefit of U.S. Provisional No. 60/104,182 filed Oct. 14, 1998.

BACKGROUND OF THE INVENTION

This invention relates to means of comfortably simulating shoulders above the head of the costume wearer so as to leave the impression of a taller person or creature. In most cases an artificial head will be employed with the shoulders, but in some cases, as in Halloween costumes, the creature simulated may be portrayed as headless.

DESCRIPTION OF THE PRIOR ART

In the past whenever the person taller than the wearer of a costume was portrayed, it was common to use a pole on which to mount the head and mount whatever additional structure was employed to support clothing. The pole itself would be carried by the person wearing the costume and thus occupy at least one of the hands of the wearer. Alternatively, the pole could be strapped to the wearer to free his hands.

Such devices, while simple and satisfactory in certain situations, are usually awkward to use and may fail to portray the character intended in realistic appearance.

SUMMARY OF THE INVENTION

The present invention is directed to a simple structure which gives the impression that the costume wearer is taller than he actually is. It is an arrangement which is intended to leave the wearer's hands free and yet provide shoulder-like platform over which a costume can be placed giving the wearer a more realistic appearance of a person or creature with shoulders. This is accomplished by providing a shoulder simulating member of the general size of the desired shoulders, both in width and length. Desired shape can be added to the shoulders as well.

The shoulder simulating platform is supported from the shoulders of the costume wearer by support columns attached to the shoulder simulating platform, spaced sufficiently far apart to accommodate the wearer's head, and preferably having the shoulder ends of the supports shaped to generally conform to the shape of the shoulders of the wearer. If an artificial head is intended to be employed on the shoulder platform, a column or post from the shoulder upon which post an artificial simulated head and neck structure can be placed to complete the illusion of the taller person.

Preferably, at least, the support columns supporting the simulated shoulder platform from the shoulders of the wearer are made of inflatable bladder material which allows them to be light weight, collapsible and thus easily portable. The ends of the inflatable bladders may also be shaped to conform to the shoulders of the wearer. It is desirable to have the shoulder simulating platform also made of inflatable bladder material to keep it light.

In addition to supporting the simulated shoulder platform from the shoulders, it is also partially supported on the top of the wearer's head. A head piece, in the form of a downward extending protrusion from the shoulder platform, allows the shoulder platform to be above the wearer's head and still have added stability of head contact. The head contacting protrusion is preferably made of an inflatable bladder material, preferably the same inflatable bladder as the simulated shoulder platform. All of these bladder structures described above may be connected together by passages so that they effectively constitute one bladder structure inflatable through a single valve. Alternatively, they may be mechanically connected individual pieces, each individually inflated.

Means to hold the simulated elevated shoulders on the wearer's head can be very simple and include ties for the head contacting portion or to the shoulder simulating portion directly, which may be tied under the chin.

More specifically, the present invention relates to a structure providing simulated shoulders elevated above the wearer's head for support of costumes or the like. The simulated shoulders provide a platform of the width and length determined by the width and length required for the shoulder portion of the costume. Support columns extend between the simulated shoulders platform and the shoulders of the wearer, spaced apart at least the largest lateral dimension of the wearer's head. Each column is attached to the shoulder simulating platform at one end and at the other end is provided with shoulder conforming terminations which generally conform to each of the wearer's shoulders. Means attached to the simulated shoulders platform is provided to hold the structure to the wearer's head.

DETAILED DESCRIPTION OF THE PREFERRED EMBODIMENTS OF THE INVENTION

Figure 1:
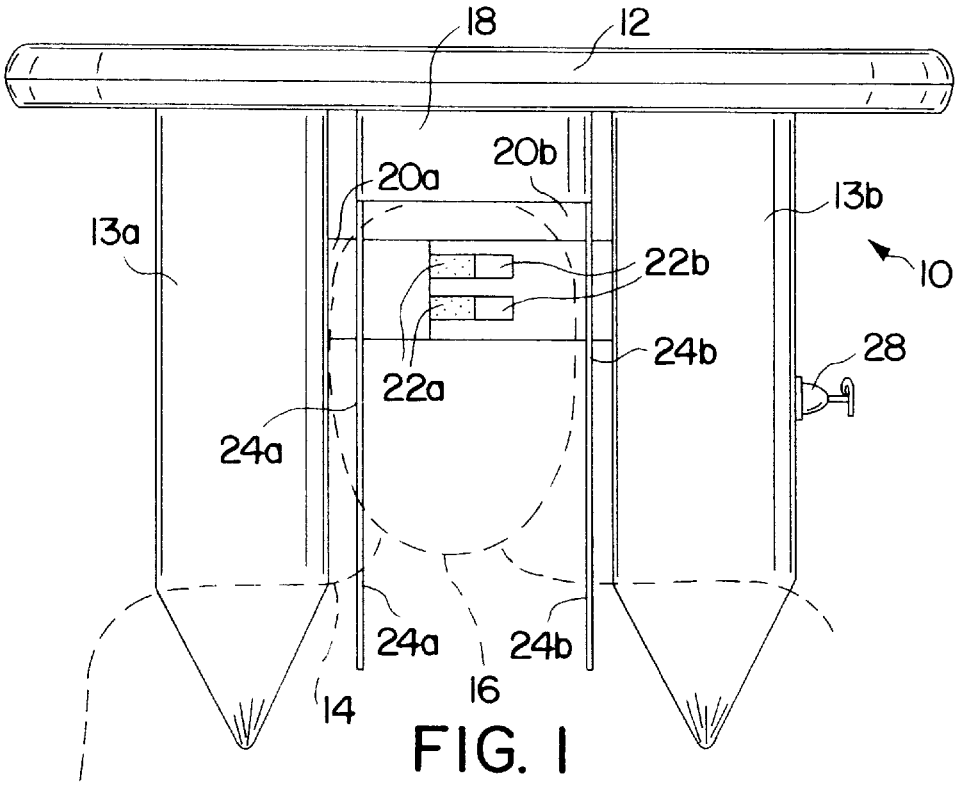
FIG. 1 is a front elevational view of the preferred embodiment of the invention without any support for a simulated head.
Figure 2:
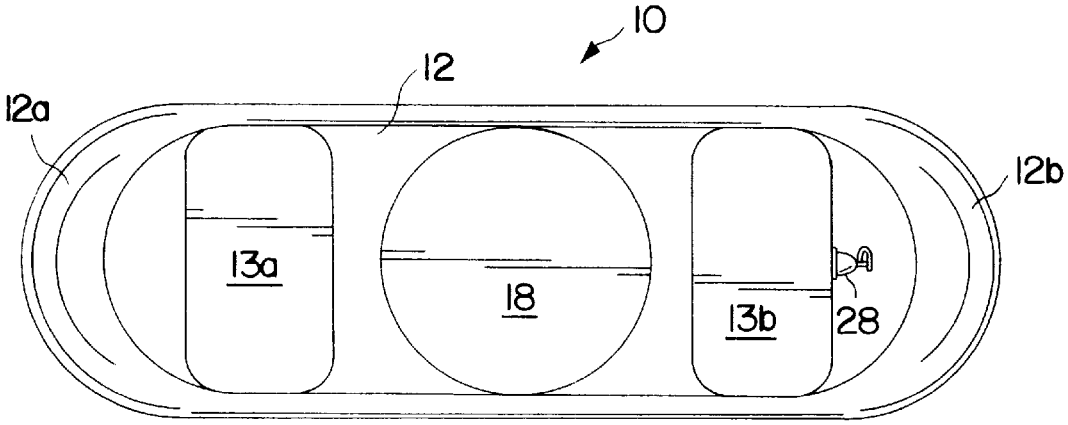
FIG. 2 is a top plan view of the structure of FIG. 1.

Referring first to FIGS. 1 and 2, a structure generally designated 10, provides simulated shoulders elevated above a wearer's head for support of costumes, or the like, to make the wearer appear taller than he is. A simulated shoulder platform 12 is of width and length determined by the width and length required for the shoulder portion of the costume, and is intended to support the weight of a robe or dress costume which hangs free from the shoulders. The platform 12 is preferably provided with rounded ends 12*a* and 12*b* as seen in FIG. 2. Similar support columns 12*a* and 12*b* are connected beneath the platform 12 to support the platform from the shoulders 14 of the wearer as shown in FIG. 1.

The positioning of the columns 12*a* and 12*b*, is such that the spacing between them allows room for the head 16 of the wearer. In this case, the head support 10 is cylindrical, but in other embodiments it could assume any shape not interfering with its support function. A head support protrusion 18 from the bottom of the platform 12 is provided to rest atop the wearer's head 16 and provide added support for the shoulder platform. To help position the wearer's head properly to engage the protrusion 18 an adjustable head band in two pieces 20*a* and 20*b*, which may be supported respectively on columns 13*a* and 13*b* and held together by suitable means Velcro® tabs 22*a* on band piece 20*a* engaging Velcro® strips 22*b* on band piece 20*b* allows a selected adjusted position for each wearer's head. Of course, other means of adjustment than Velcro® may be provided.

A pair of flexible ties 24*a* and 24*b* attached to the head supporting protrusion 18 of the platform 12, may be secured together at their free ends by tying them under the wearer's chin as shown in FIG. 1. The ties 24*a* and 24*b*, may be alternatively attached to the platform 12 at another place or even to the columns 12*a* and 12*b*, well above the wearer's chin.

It will be observed that the platform 12 and columns 12*a* and 12*b* and the head support 18 are not only physically attached to one another to make the unitary structure 10, but are composed in major part of "bladders," or inflatable parts. The inflatable members, in this embodiment, have their interior inflatable portions connected to one another. The hollow inflatable members may be difficult to make in an unitary structure, and even more difficult to assure adequate air passages from one to another, which is complicated if not made as a single piece. In this particular case, in addition to mechanical attachment of pieces to one another their bladders are interconnected and inflatable by a single valve 28. The valve may be quite simple and conventional, basically a heavier tubular piece through which a user can blow to inflate the whole structure 10. The valve is closed by a tapered molded pin to hold the air within the connected bladders once it has been blown up. Since these spaces are interconnecting so that the whole structure may be blown up through the one valve 28 it is desirable to have the interconnecting passages (not shown) sufficiently large to ease the task of the inflater. As is typically done with bladders a tubular valve body may be molded integrally with the wall through which it passes. The frictionally retained stopper is preferably molded with the tube and attached to the valve body by a strip. Of course, any type of valve construction suitable to the application can be used, including separately molded flanged valves glued or heat sealed to the bladder at the edges of a small hole therethrough provided for the purpose. This type of simple valve allows the user to inflate the simulated shoulders structure so that it is quickly ready for use. When it is to be stored, the structure can be quickly deflated and folded flat for convenient storage.

Figure 3:
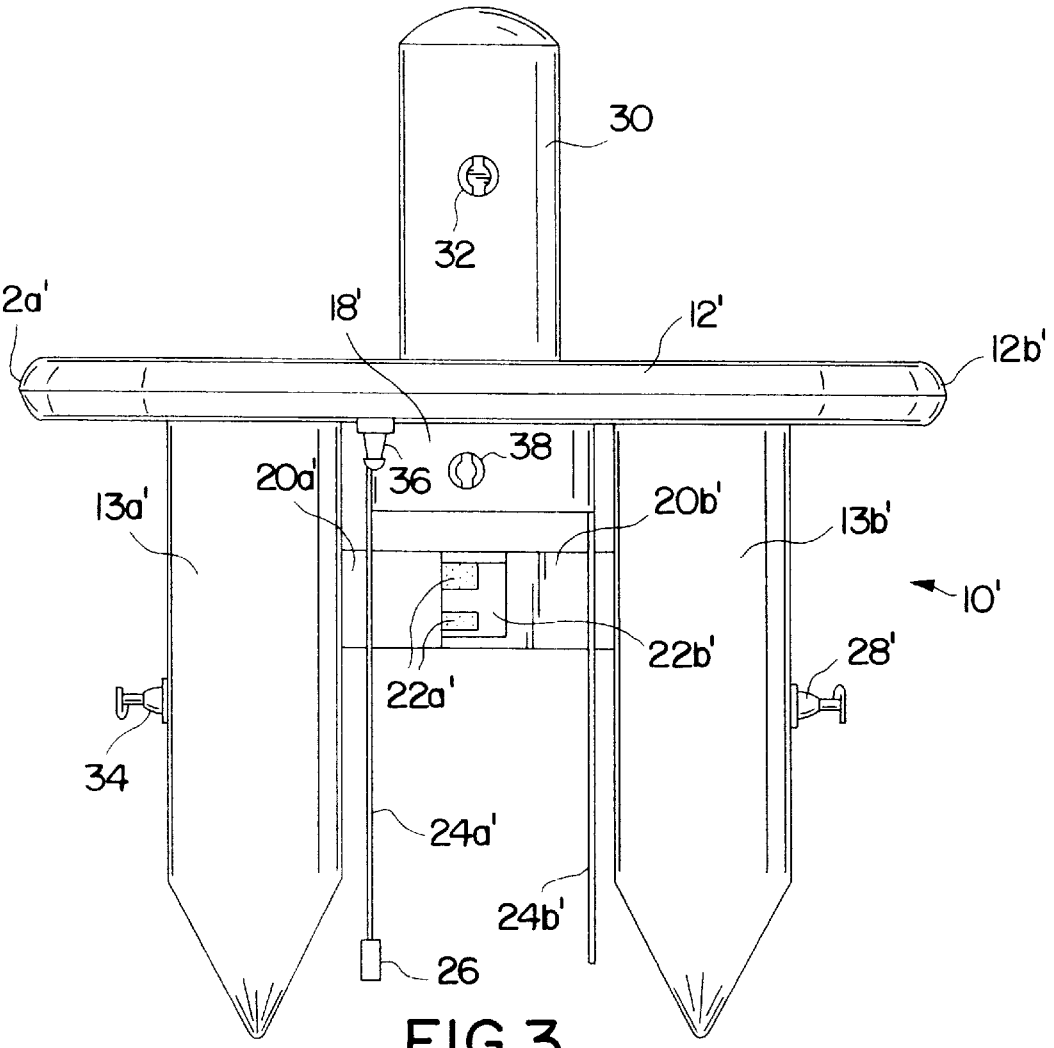
FIG. 3 is a front elevational view similar to FIG. 1, but with a head supporting post in place.
Figure 4:
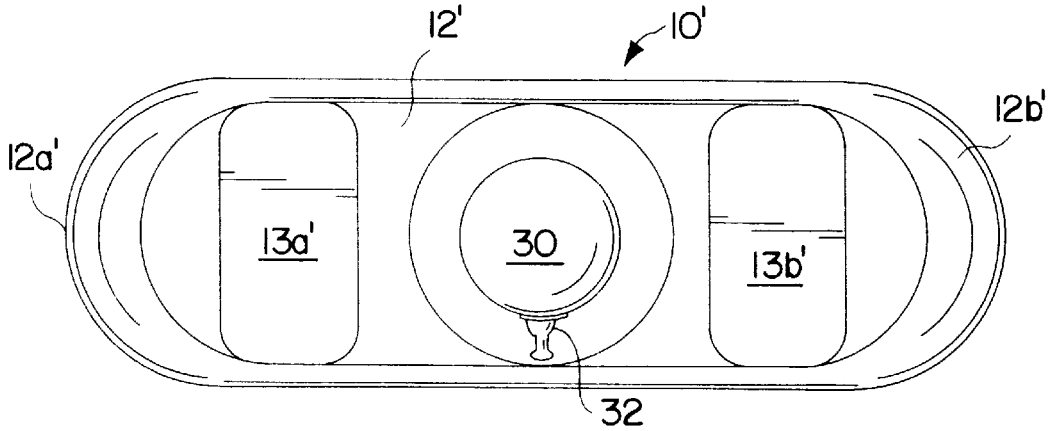
FIG. 4 is a plan view from above of the structure of FIG. 3.
Figure 5:
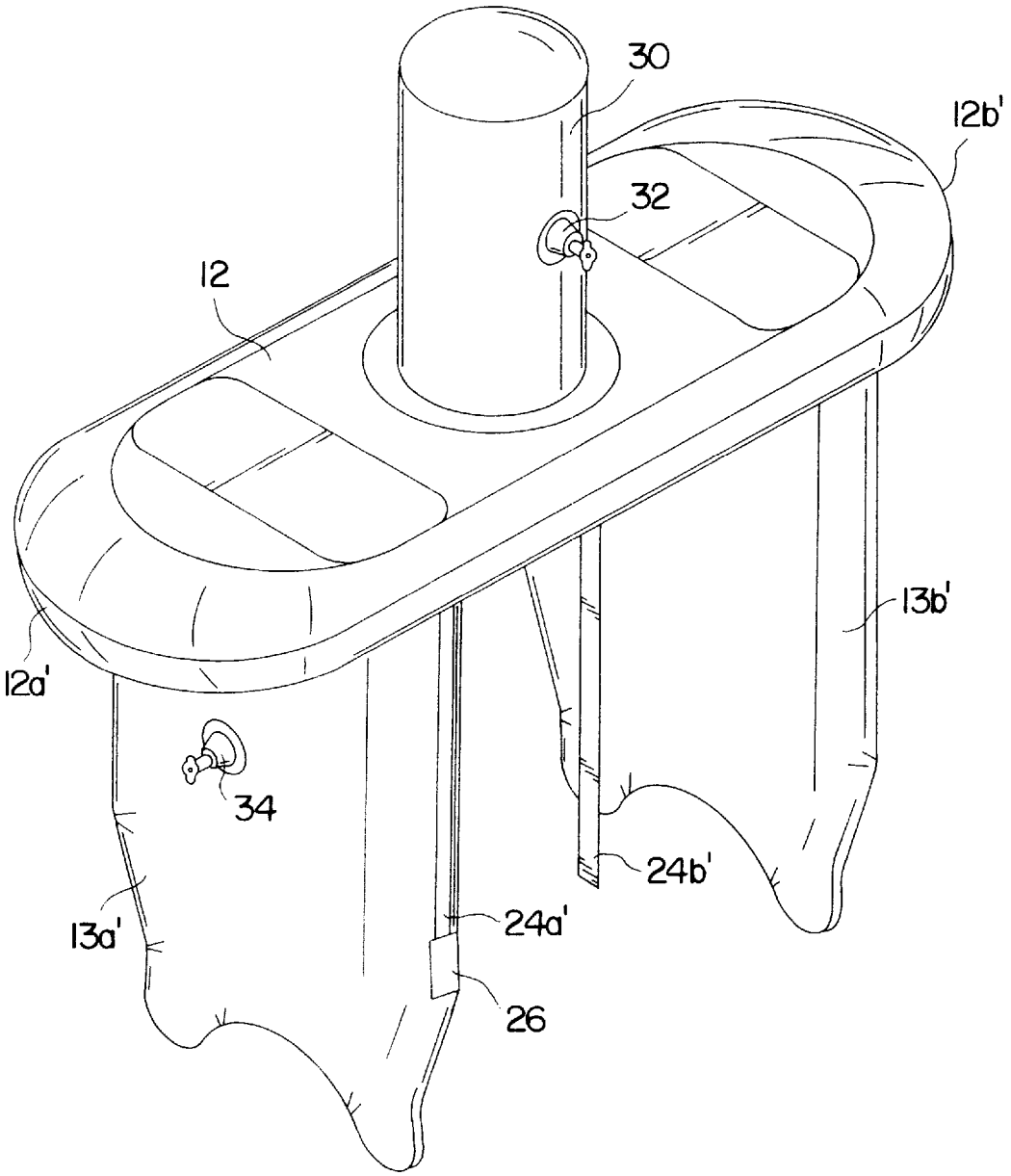
FIG. 5 is a perspective view of the preferred embodiment of FIGS. 3 and 4.

Referring now to FIGS. 3–6 and particularly FIGS. 3 and 4, the structure shown is quite similar to that of FIGS. 1 and 2 and is similar in use. FIG. 5 shows in perspective the structure, permitting a better view of shape of various parts. Similar parts performing similar functions are given the same numbers as in FIGS. 1 and 2, but with the addition of primes thereto. A prominent and functionally important additional piece is the head post 30 to which a head may be easily mounted. As with the other pieces, the head post could be made of a solid piece, or even a tubular piece, but the inflatable form allows it to be lighter and still be quite functional for costume purposes. In its simplest form, a neck piece or other portion of the costume head may be sized and designed to slide over and frictionally engage the head post 30 to support the head. More elaborate means of attaching the head either to a post or to the top surface of the shoulders 12, exist and are known in general from the art. However, the inflatable post has an important advantage, particularly when provided as a separate bladder or inflatable chamber, with a separate inflatable compartment accessed by a valve 32. In such an event, the post can be deflated leaving the rest of the structure inflated and the post is essentially out of the way to provide the headless shoulder arrangement of FIGS. 1 and 2. Separate valves 28' and 34 are shown in columns 13*a*' and 13*b*', respectively into which is constructed essentially like that of FIGS. 1 and 2. However, the individual bladders of the various structural elements have no connection to one another in the FIGS. 3 and 4 version, in the FIGS. 3 and 4 embodiment even the head contacting protrusion 18' which is connected to the shoulder simulating member 12 has a separate valve 38. Such construction might serve the additional function of allowing variable inflation of the head piece protrusion to accommodate a different wearer head size. Such an adjustment in the vertical direction is in addition to the adjustment of a head band 20*a*' and 20*b*' to help hold the structure in proper relationship to the head by contacting the back of the head in a comfortable adjustable position. Instead of using ties in this particular embodiment, there are straps or belts 24*a*' and 24*b*' and a buckle 26 is attached to the strap 24*a*'. Alternatively the straps could be provided with a Velcro® connection as well as the bands 20*a*' and 20*b*' for securing the structure around the chin of the wearer.

Figure 6:
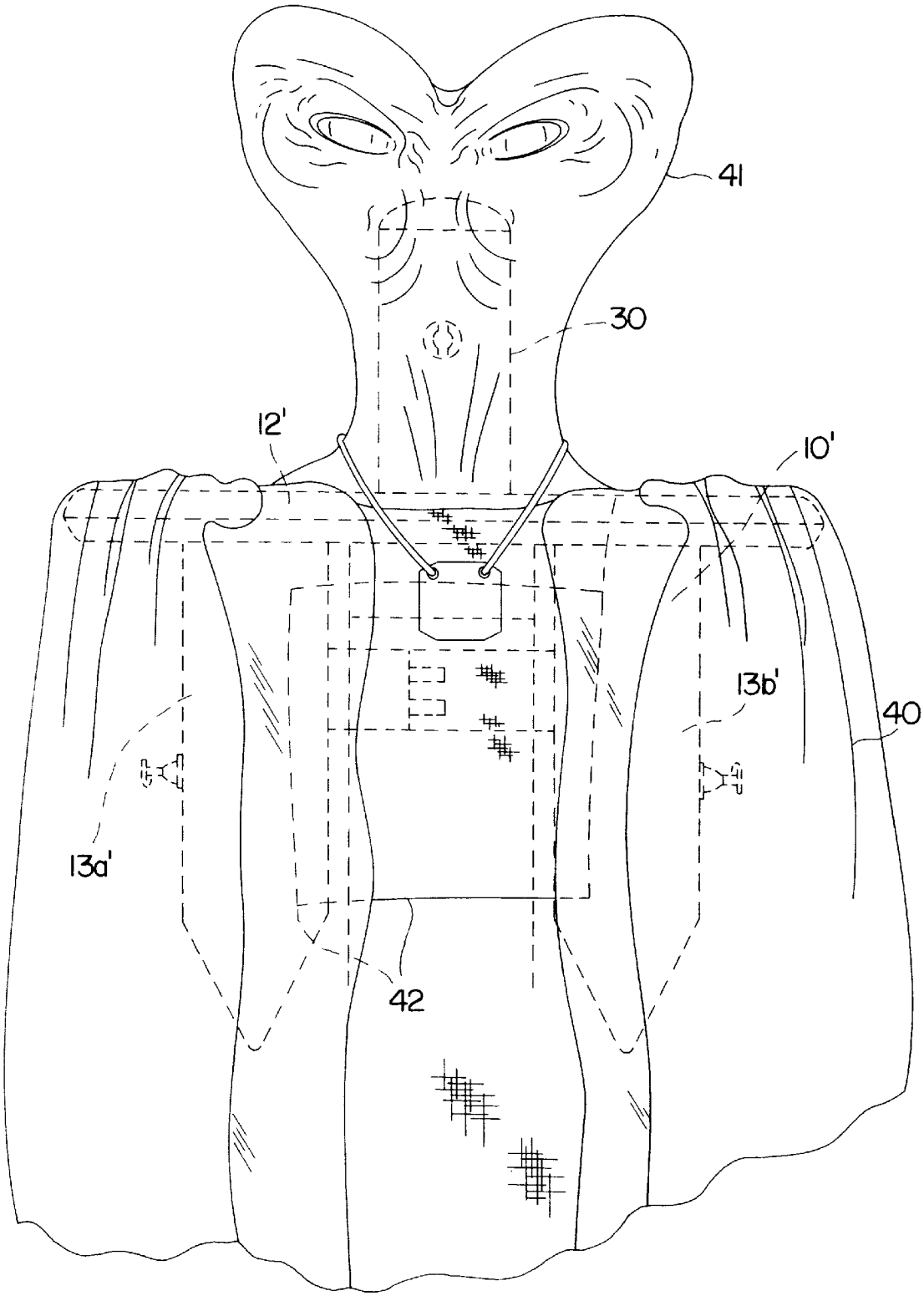
FIG. 6 is front view of a costume employed with the simulated shoulder structure of FIGS. 3–5.

FIG. 6 shows a costume and a head supported on the simulated elevated shoulders. It will be appreciated that with a costume of this sort, the shoulders of the costume can be made to fit the shoulder member 12' which will tend to help keep the costume in place just as shoulders in a suit or dress keep clothing in the right position on the wearer. However, in this case, the costume 40 covers the wearer's face and probably extends to the ground or close to the ground in a great majority of cases. An artificial head 41 is provided to fit over post 30.

In the area where the costume covers the wearer's face, some sort of provision allowing the wearer to see through the costume is needed. A simple means of providing vision is to use a panel 42 of cloth or other mesh material sufficiently fine that from a distance one does not see through it, but from the close proximity which the wearer enjoys allows vision through the material. The panel may be sewn to the cloth of the costume or otherwise suitable affixed thereto.

The invention has been describes in terms of specific embodiments having parts of inflatable form. It will be understood by those skilled in the art that rigid, preferably light weight materials, may be substituted for some or all of the structure. However, not having the pieces inflatable usually constitutes significant disadvantage in terms of added weight and decreasing the possibility of the structure being easily deflated and folded up. Some more rigid materials substituted for some piece might even be more comfortable, depending upon the material used and the weight of that material. Inflatable material, of course, has the advantage of being somewhat yieldable so that it will conform, for example, more closely to the wearer's shoulders. The head piece 18 or 18' can be used fully inflated or, in this embodiment with its own valve 38 separate from that of the shoulders platform can be partially deflated when the wearer's head is somewhat larger than the contemplated size. Indeed in some cases, the head size, if great enough, might not require the head piece at all and it could not be inflated under those circumstances.

Many variations on the embodiments shown will occur to those skilled in the art, given known practices with various materials represented. Other materials might be substituted to take advantage of their known properties. Material for the inflatable part commonly might be polyvinalchloride or some variation thereof or many other products including natural or synthetic rubber products. All such modifications within the scope of the claims which would occur in those skilled in the art are intended to be within the scope of the present invention.

We claim:

1. A structure providing simulated shoulders elevated above a wearer's head for support of costumes or the like, comprising:

a simulated shoulder platform of a width and length determined by the width and length required for a shoulder portion of the costume;

support columns extending downwardly from the shoulder platform and terminating at the wearer's shoulders, each column attached at one end to the shoulder platform and spaced apart at least the largest lateral dimension of a wearer's head, the support columns formed of hollow flexible inflatable bladders attached to the shoulder platform at their tops, which columns when inflated provide sufficiently rigid columns for support, with the shoulder engaging column bottoms generally conforming to a wearer's shoulders in order to rest on the wearer's shoulders; and flexible means attached to the support columns to hold the structure to the wearer.

2. The simulated shoulders structure of claim 1, in which the simulated shoulder platform is an inflatable bladder member.

3. A structure providing simulated shoulders elevated above a wearer's head for support of costumes or the like, comprising:

a simulated shoulder platform of a width and length determined by the width and length required for a shoulder portion of the costume;

support columns extending downwardly from the shoulder platform, each column attached at one end to the shoulder platform and spaced apart at least the largest lateral dimension of a wearer's head;

a post attached to the simulated shoulders platform on the opposite side from the support columns to provide support for an artificial head, the post comprising an inflatable bladder; and flexible means attached to the support columns to hold the structure to the wearer.

4. A structure providing simulated shoulders elevated above a wearer's head for support of costumes or the like, comprising:

a simulated shoulder platform of a width and length determined by the width and length required for a shoulder portion of the costume;

support columns extending downwardly from the shoulder platform, each column attached at one end to the shoulder platform and spaced apart at least the largest lateral dimension of a wearer's head;

a post attached to the simulated shoulders platform on the opposite side from the support columns to provide support for an artificial head, the post extending upward from a inflatable bladder member providing the simulated shoulder platform; and flexible means attached to the support columns to hold the structure to the wearer.

5. The simulated shoulder structure of claim 4, in which the upward extending post to support an artificial head is of inflatable bladder construction.

6. A costume comprising:

a structure providing simulated shoulders elevated above a wearer's head having a simulated shoulder platform of a width and length determined by the width and length required for a shoulder portion of the costume, support columns extending downwardly from the shoulder platform, each column attached at one end to the shoulder platform and spaced apart at least the largest lateral dimension of a wearer's head, and flexible means attached to the support columns to hold the structure to the wearer; and a flexible fabric garment for covering the shoulders and hanging some distance around the wearer toward the ground, the fabric garment having a panel of flexible mesh through which it is difficult to see the wearer within the costume, but which enables the wearer, due to his proximity to the mesh, to see through the mesh with relative clear visibility, allowing the wearer to see beyond the costume.

7. A costume comprising:

a structure providing simulated shoulders elevated above a wearer's head having a simulated shoulder platform of a width and length determined by the width and length required for a shoulder portion of the costume, support columns extending downwardly from the shoulder platform, each column attached at one end to the shoulder platform and spaced apart at least the largest lateral dimension of a wearer's head, a post attached to the shoulder platform on the opposite side from the support columns to provide support for an simulated head, a simulated head mounted on the post, and flexible means attached to the support columns to hold the structure to the wearer; and a flexible fabric garment for covering the shoulders and hanging some distance around the wearer toward the ground, the fabric having means included as part of the fabric for allowing the wearer to see beyond the costume.

8. The costume of claim 7, wherein the means for allowing the wearer to see is a panel of flexible mesh through which it is difficult to see the wearer within the costume, but which enables the wearer, due to his proximity to the mesh, to see through the mesh with relative clear visibility.

9. A simulated shoulder comprising:

a) a platform including i) an upper and a lower surface, ii) horizontally disposed support columns defining the periphery of the shoulder platform, and iii) a head supporting structure attached to the upper surface for support of an inflatable bladder;

b) an inflatable bladder attached to the head supporting structure for simulating a head and supporting a costume mask;

c) at least one elongated support column extending downwardly from the platform, each column i) attached at one end to the platform, and ii) spaced apart at least the largest lateral dimension of a wearer's head; and d) flexible means attached to the support columns to hold the structure to a wearer for supporting the simulated shoulder platform, the flexible means further having adjustable means extending from the support columns, portions of the adjustable means releasably engaging the wearer.

10. A costume comprising in combination:

a) a structure providing simulated shoulders elevated above a wearer's head, the structure, including i) an upper and a lower surface, ii) horizontally disposed support columns defining the periphery of the simulated shoulder, and iii) a head supporting structure attached to the upper surface for support of an inflatable bladder;

b) an inflatable bladder attached to the head supporting structure for simulating a head and supporting a costume mask;

c) at least one elongated support column extending downwardly from the simulated shoulder, each column
   i) attached at one end to the simulated shoulder, and
   ii) spaced apart at least the largest lateral dimension of a wearer's head;

d) flexible means attached to the support columns to hold the structure to a wearer for supporting the simulated shoulder, the flexible means having adjustable means extending from the support columns, portions of the adjustable means releasably engaging the wearer;

e) an artificial head disposed over at least a portion of the inflatable bladder; and f) a flexible fabric covering the structure and hanging some distance around the wearer toward the ground, a means included as part of the fabric which allows the wearer to see beyond the costume.

* * * * *